United States Patent [19]

Andis et al.

[11] Patent Number: 4,756,320

[45] Date of Patent: Jul. 12, 1988

[54] HAIR CURLING APPLIANCE WITH A HEATING ELEMENT COMPRISING A HEATING WIRE WOUND AROUND AN INNER CORE

[75] Inventors: Matthew L. Andis; Thomas C. Maddocks, both of Racine; Charles H. Heide, Kenosha, all of Wis.

[73] Assignee: Outboard Marine Corporation, Waukegan, Ill.

[21] Appl. No.: 599,753

[22] Filed: Apr. 13, 1984

[51] Int. Cl.[4] ..... A45D 2/12

[52] U.S. Cl. ..... 132/33 R; 132/36 R; 219/226; 219/225

[58] Field of Search ..... 132/33 R, 36 R, 36 A, 132/36 B, 36 C, 36 D, 117, 118, 9, 31 R, 32 R; 219/222, 242, 223, 226, 225, 233, 240; D28/38

[56] References Cited

U.S. PATENT DOCUMENTS

| | | | |
|---|---|---|---|
| 1,173,621 | 2/1916 | Thornton | 219/226 |
| 3,283,122 | 11/1966 | McNair | 132/33 R |
| 3,316,385 | 4/1967 | Anton | 219/236 |
| 3,382,876 | 5/1968 | Spier | 132/33 R |
| 3,483,876 | 12/1969 | Planel | 132/33 |
| 3,486,000 | 12/1969 | D'Elia et al. | 219/222 |
| 3,487,197 | 12/1969 | D'Elia et al. | 132/33 R |
| 3,488,471 | 1/1970 | Gstalder | 132/33 R |
| 3,603,765 | 9/1971 | Underwood | 219/222 |
| 3,760,148 | 9/1973 | Boudouris et al. | 132/33 R |
| 3,784,784 | 1/1974 | Geominy et al. | 132/33 R |
| 4,227,541 | 10/1980 | Satchell | 132/37 R |
| 4,354,092 | 10/1982 | Manabe et al. | 132/37 R |

FOREIGN PATENT DOCUMENTS

| | | | |
|---|---|---|---|
| 472872 | 4/1951 | Canada | 219/222 |
| 1326121 | 8/1973 | United Kingdom | 219/222 |
| 2077098 | 12/1981 | United Kingdom | 219/226 |

*Primary Examiner*—John Weiss

*Attorney, Agent, or Firm*—Michael, Best & Friedrich

[57] ABSTRACT

A hair curling appliance comprising a handle, a heating element fixedly extending from the handle and comprising an inner member made of heat insulating material and including an outer surface, an outer member which telescopically receives the inner member and which is made of elastomeric material, and a low resistance heating wire which is secured between the inner member and the outer member and which is wound around and covers a portion of the inner member outer surface, and a rechargeable battery for energizing the low resistance heating wire. The outer member also includes an inner surface formed around the wire's peripheral surface so as to increase the amount of surface contact and resultant heating by conduction between the low resistance wire and the outer member.

9 Claims, 2 Drawing Sheets

HAIR CURLING APPLIANCE WITH A HEATING ELEMENT COMPRISING A HEATING WIRE WOUND AROUND AN INNER CORE

RELATED APPLICATION

Attention is directed to the related Andis application filed as Ser. No. 599,752 filed the same day as this application.

BACKGROUND OF THE INVENTION

This invention relates to hair curling appliances, and, more particularly, to hair curling appliances including a heating element comprising a heating wire wound around an inner core. Even more particularly, this invention relates to battery operated, hand-held hair curling appliances.

Attention is directed to Planel U.S. Pat. No. 3,483,876 and D'Elia, et al. U.S. Pat. No. 3,486,000 which disclose hair curling appliances with a heating element including a heating wire wound around an inner core.

Attention is also directed to a battery operated hair curling appliance sold by the Wahl Clipper Corp. including a heating element which fixedly extends from a handle assembly and which includes a coiled aluminum heating wire wrapped in plastic film and located inside a hollow metal cylindrical tube.

SUMMARY OF THE INVENTION

This invention provides a hair curling appliance comprising a handle, a heating element fixedly extending from the handle and comprising an inner member including an outer surface, an outer member which telescopically receives the inner member, and means for heating the outer member and comprising a resistance heating wire which is secured between the inner member and the outer member and which is wound around and covers a portion of the inner member outer surface, and means for energizing the resistance heating wire and comprising power storage means.

In one embodiment, the resistance heating wire comprises low resistance wire.

This invention also provides a hair curling appliance comprising a heating element comprising an inner member made of heat insulating material, an outer member which telescopically receives the inner member, and means for heating the outer member.

In one embodiment, the inner member includes an outer surface and the means for heating the outer member comprises a resistance heating wire which is secured between the inner member and the outer member and which is wound around and covers a portion of the inner member outer surface. The outer member is also made of poor heat conducting material.

This invention also provides a hair curling appliance comprising a heating element comprising an inner member including an outer surface, a resistance heating wire which includes a peripheral surface and which is wound around and covers a portion of the inner member outer surface, and an outer member which telescopically receives the inner member and the resistance heating wire and which includes an inner surface formed around the wire peripheral surface so as to increase the amount of surface contact and resultant heating by conduction between the resistance heating wire and the outer member.

In one embodiment, the outer member is made of elastomeric material and the resistance heating wire is low resistance wire. The appliance also includes means for energizing the low resistance wire and comprising power storage means stored in a handle fixedly attached to the heating element.

In one embodiment, the outer member outer surface includes radially extending grooming means, and, in another embodiment, the hair curling appliance includes clamping means for clamping hair to the heating element.

In another embodiment, the outer member includes a portion which is made of heat conducting metal and which is adjacent the wound, low resistance wire.

One of the principal features of the invention is the provision of a hair curling appliance including a heating element which heats quickly and uniformly, and achieves adequate curling temperature.

Another of the principal features of the invention is the provision of such a hair curling appliance that is battery operated and usable for an extended period of time.

Another of the principal features of the invention is the provision of a hair curling appliance including a heating element which is thermally efficient and has a flexible outer surface.

Other features and advantages of embodiments of the invention will become apparent upon reviewing the following drawings, the detailed description and the appended claims.

Figure 8:
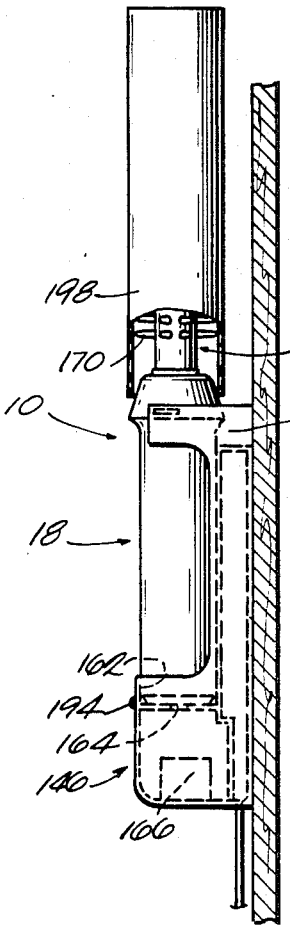
FIG. 8 is a side perspective view of the hair curling appliance of FIG. 1 in a charging cradle.

Before explaining at least one embodiment ot the invention in detail, it is to be understood that the invention is not limited in its application to the details of construction and the arrangement of the components set forth in the following description or illustrated in the drawings. The invention is capable of other embodiments and of being practiced or carried out in various ways. Also, it is to be understood that the phraseology and terminology employed herein is for purposes of description and should not be regarded as limiting.

DESCRIPTION OF THE PREFERRED EMBODIMENT

Figure 1:
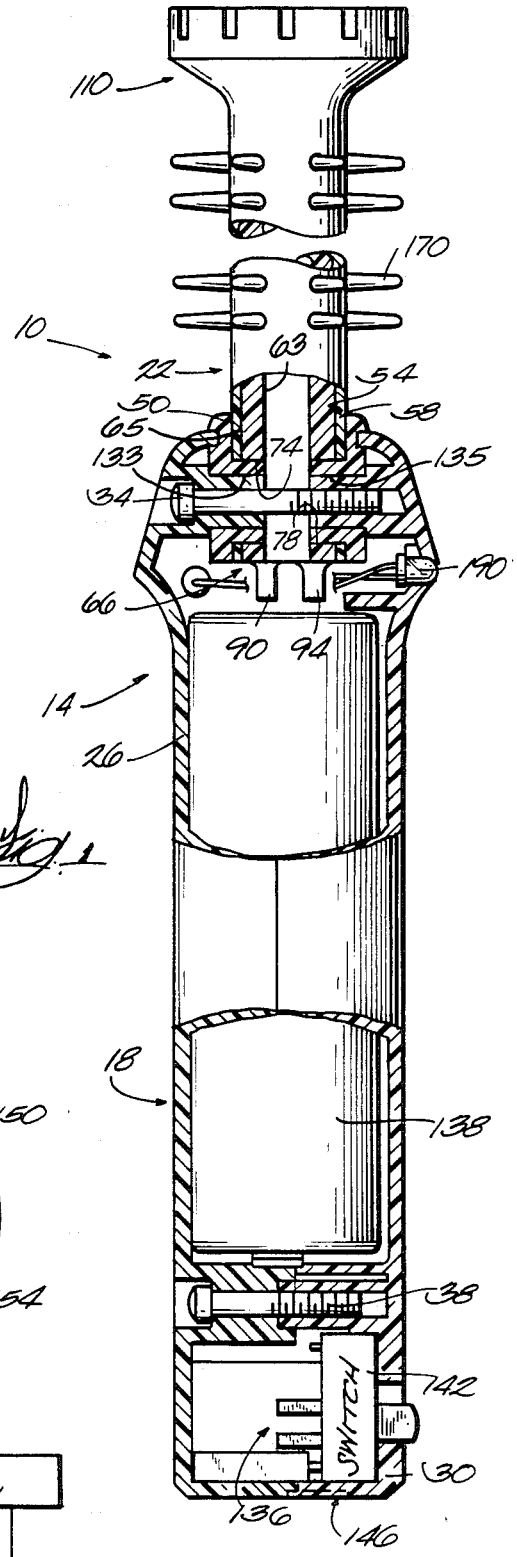
FIG. 1 is a perspective view, partially broken away, of a hair curling appliance which embodies various of the features of the invention.

Illustrated in FIG. 1 is a hair curling appliance which, in this embodiment, takes the form of a hair curler 10.

The hair curler 10 includes a handle assembly 14 including a handle 18 and a fixedly extending heating element 22. More particularly, the handle 18 comprises two handle portions 26 and 30 which are secured by two housing screws 34 and 38 received in bores in mating projections in the interiors of the two handle portions 26 and 30. The handle portions can be constructed in various ways and, in the illustrated construction, are fabricated from a plastic such as polycarbonate. The handle 18 also includes a housing end cap 50 to assist in securing the heating element 22 to the handle 18, as hereinafter described.

Figure 2:
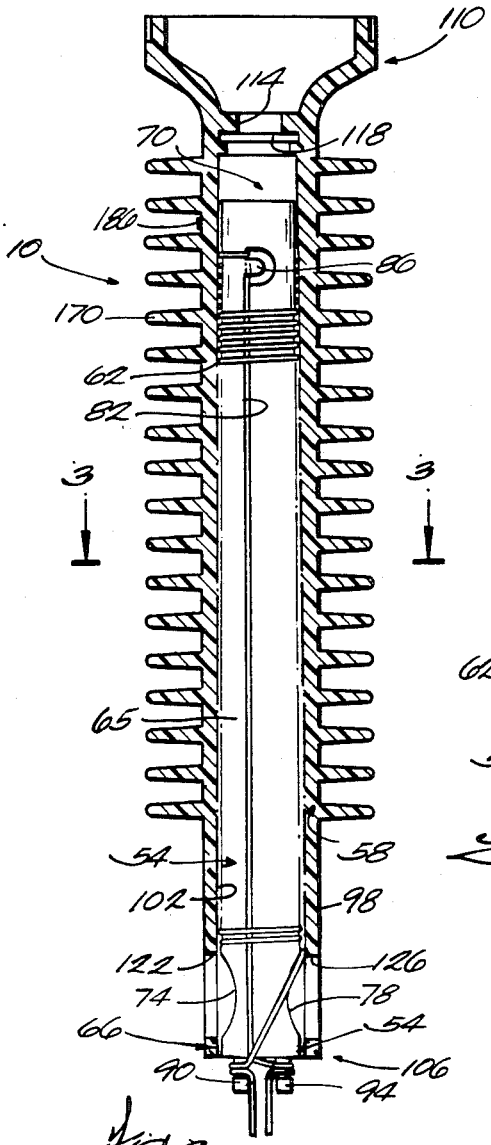
FIG. 2 is a cross-sectional view of the heating element which is shown in FIG. 1 and which embodies various of the features of the invention.
Figure 3:
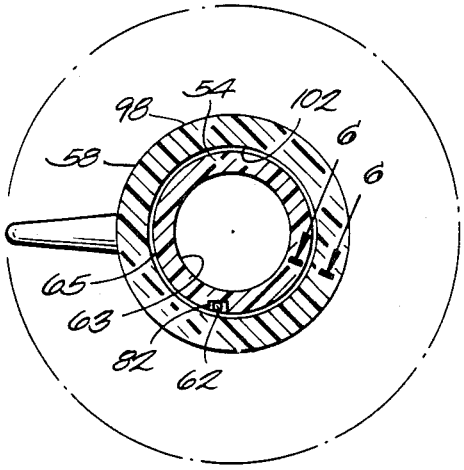
FIG. 3 is a cross-sectional view taken along line 3—3 in FIG. 2.

As illustrated in FIGS. 1, 2, and 3, the heating element 22 comprises an inner core or member 54, an outer member 58 which telescopically receives the inner member 54, and means in the form of a wound resistance heating wire 62 secured between the inner member 54 and the outer member 58 for heating the outer member 58.

More particularly, the inner member 54 is elongated, has a generally annular transverse cross section (as shown in FIG. 3), and includes an inner surface 63 and an outer surface 65. In the preferred embodiment shown the inner member 54 is also tapered with a 0.5° draft. The inner member 54 also includes an outer end 70 and an inner end 66 which is fixed inside the handle 18. The inner end 66 includes means for fixing the inner member 54 in the handle 18, which means comprises opposed openings 74 and 78.

Although some features of the invention can be obtained with the inner member 54 being made of other materials, in the preferred embodiment, the inner member 54 is made of a heat insulating material, such as a fiber or glass filled nylon material. The glass filled nylon material has low heat conductivity and is capable of sustaining the high temperatures achieved by the resistance heating wire 62. Since the inner member 54 is made of heat insulating material, heating of the inner member 54 by the resistance heating wire 62 is limited, and the heating efficiency of the heating element 22 is therefore improved over heating elements with inner members made of other materials.

While other constructions can be employed in other embodiments, the inner member 54 (see FIG. 2) further includes means for facilitating connection of the resistance heating wire 62 to the inner member 54, which means comprises an axially extending slot 82 in the outer surface 65 of the inner member 54. The axial slot 82 extends from the inner end 66 of the inner member 54 to just short of the outer end 70 of the inner member 54. At the outer end of the slot 82 is a U-shaped opening which defines a tab 86 which extends at a right angle to the slot 82. The wire connecting means also includes two spaced apart L-shaped anchor posts 90 and 94 which extend axially outward from the inner end 66 of the inner member 54.

As illustrated in FIGS. 1, 2 and 3, the outer member 58 is elongated and includes an outer surface 98 and an inner tapered surface 102. In the preferred embodiment, the inner tapered surface 102 has a 0.5° draft which conforms to the outer surface 65 of the inner member 54. The outer member 58 also includes an outer end 110 and an inner end 106 which is secured in the handle 18. The outer member 58 has an annular transverse cross section and the free outer end 110 is flared outward and extended so as to provide convenient means allowing the hair appliance user to grasp the heating element 22 during use. An axial opening 114 in the outer member 58 is closed adjacent the flared outer end 110 by means of a plug 118.

The inner end 106 of the outer member 58 includes means for connecting the outer member 58 to the handle 18, which means comprises opposed openings 122 and 126 which are aligned with the opposed openings 74 and 78 in the inner member 54 when the inner member 54 and outer member 58 are assembled.

In the preferred embodiment illustrated in FIG. 1, the outer member 58 is made of an elastomeric material. The elastomeric material is an elastomeric thermoplastic polyolefinic compound with a hardness ranging between 73 shore A and 50 shore D. This material is substantially softer than a metal cylinder and thus provides for greater comfort for a hair curler user. Although the outer member 58 is flexible, the heating element 22 does not bend when curling hair because of the presence of the fairly rigid inner member 54.

The elastomeric thermoplastic polyolefinic compound is a commercially available compound, an example of which is sold by the Mansanto Industrial Chemical Co., Rubber Chemicals Division, located at 260 Springside Dr., Akron, Ohio. The compound is described by Mansanto as a thermoplastic rubber and is identified by the federally registered trademark of SANTOPRENE. The SANTOPRENE thermoplastic rubber is sold in hardnesses ranging from 73 shore A to 50 shore D, and numerical hardnesses ranging from 40 to 87.

The elastomeric material is a poor heat conducting material. The use of a poor heat conducting material is advantageous for it permits the portion of the outer member 58 adjacent the wound wire 62 to be heated by the wire 62, while not heating the inner or outer ends of the outer member 58. This prevents heat loss from the inner and outer ends of the outer member 58 and thus improves the heating efficiency of the heating element 22. In other embodiments, other poor heat conducting materials, such as nylon, can be used.

Figure 5:
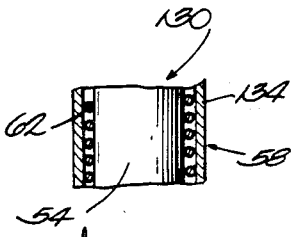
FIG. 5 is a cross-sectional view of an alternate embodiment of the heating element shown in FIG. 2.

In another embodiment 130, as shown in FIG. 5, the outer member 58 can include a metal portion 134 which is adjacent the resistance heating wire 62 wound around the inner member 54. The metal portion 134 shown would be co-extensive with the wound wire 62. The remainder of the outer member 58 (not shown) is made of poor heat conducting material, in a manner similar to FIG. 2.

As illustrated in FIG. 2, the resistance heating wire 62 is secured between the outer member 58 and the inner member 54 and is wound around a portion of the inner member 54. More particularly, the resistance heating wire 62 is wound around the post 94 to secure one end, then extends up the axial slot 82 and under and around the tab 86, and then spirals around the inner member outer surface 65 back along the axial slot 82 and then around the post 90 to secure the other end of the wire 62. In other embodiments, the outer surface 65 of the inner member 54 can include a spiral slot (not shown) to assist in spacing the wire 62 along the inner member 54.

Figure 6:
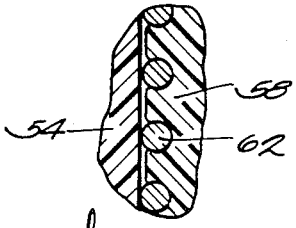
FIG. 6 is an enlarged cross-sectional view taken along line 6—6 in FIG. 3 of a portion of a heating element which embodies various of the features of the invention.

To assemble the heating element 22, the inner member 54 with the wound heat resistance wire 62 is press fitted into the outer member 58. By virtue of the tapered surfaces 65 and 102, the press fitting, and the elastomeric material forming the outer member 58, the inner surface 102 of the outer member 58 forms, or more specifically deforms, around the heat resistance wire 62 (as illustrated in FIG. 6), thereby increasing the amount of surface contact between the peripheral surface of the heat resistance wire 62 and the outer member inner surface 102. This increase in the relative amount of surface contact between the wire 62 and the outer member 58 increases the amount of surface for providing heat transfer by conduction, thereby improving the heating efficiency of the heating element 22. In addition to assisting in causing this deformation, the tapered surfaces 65 and 102 provides for greater uniformity of press fitting and deformation along the heating element 22.

In addition to press fitting the inner member 54 into the outer member 58, the outer member 58 can be molded around the inner member 54 and the resistance heating wire 62 so that the outer member inner surface 102 is formed around the peripheral surface of the heating wire 62, as illustrated in FIG. 6. This manufacturing method is especially advantageous when an outer member made of harder moldable materials is desired.

When the inner member 54 and outer member 58 are assembled, the openings 74 and 78 in the inner member 54 are aligned with the openings 122 and 126 in the outer member 58. The inner member 54 and outer member 58 are received in the housing end cap 50, and openings 133 and 135 in the end cap 50 are aligned with the openings in the inner and outer members 54 and 58, respectively. The housing screw 34 in the handle 18 extends through the openings in the inner member 54, the outer member 58, and the housing end cap 50 to secure the heating element 22 to the handle 18.

Figure 7:
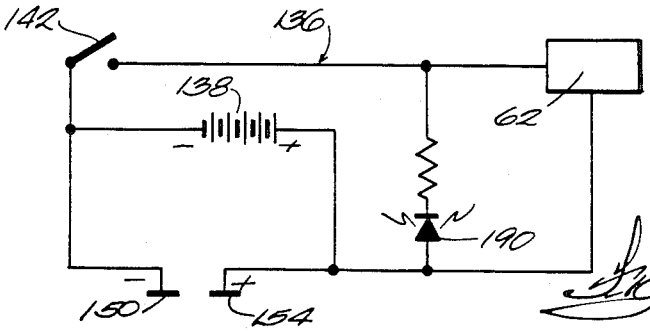
FIG. 7 is a wiring diagram for the hair curling appliance shown in FIG. 1.

As illustrated in FIGS. 1 and 7, the hair curler 10 also includes means 136 for energizing the resistance heating wire 62, which means 136 comprises power storage means in the form of a rechargeable battery 138. The rechargeable battery 138 is secured in the handle portions 26 and 30. In other embodiments, disposable batteries can be used.

The means 136 for energizing the wire also includes means for connecting the rechargeable battery 138 to the resistance heating wire 62, which means includes a manually operable switch 142 for controlling energizing of the resistance heating wire 62.

In order to maximize the life of the battery 138 while providing adequate curling heat, the heat resistance wire 62 is made of a low electrical resistance material, such as copper, unlike the nicrome heating wire normally used for hair curling appliances. In the preferred embodiment, the low resistance wire is in the form of standard coated copper winding wire.

In order to provide for adequate curling temperatures, greater battery life, proper speed of heating of the outer member 58, and uniform heat along the outer member 58, a particular range of copper wire sizes, turns and wound wire length are preferably used. A proper range of values is illustrated in the following table.

| Wire Size (mils) | Turns | Feet |
|---|---|---|
| 25.35 | 120–145 | 13–18 |
| 22.57 | 110–135 | 12–16 |
| 20.10 | 100–125 | 11–14 |
| 17.90 | 90–115 | 9–12 |
| 15.94 | 70–95 | 7–10 |
| 14.20 | 50–75 | 5–8 |

In the preferred embodiment, a wire size of 15.94 mils (thousands of an inch) is used. The wire is wound 80 turns around the inner member 54 and has a wound length of 8.7 feet.

Figure 4:
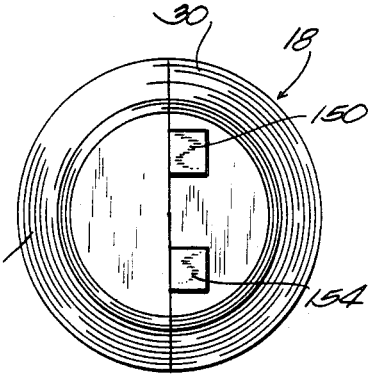
FIG. 4 is an end view of the handle of the hair curling appliance shown in FIG. 1.

The hair curler 10 also includes means 146 for recharging the rechargeable battery 138. As illustrated in FIGS. 1, 4 and 7, the means 146 for charging the rechargeable battery 138 comprises a pair of leads which run from respective ends of the battery 138 to contacts 150 and 154 on the free end of the handle 18.

As illustrated in FIG. 8, the recharging means also includes a hair curling appliance receptical or cradle 158 which includes a socket 162. In the socket 162 are contacts 164 (only one is shown) which connect with the contacts 150 and 154 on the end of the handle 18 of the hair curler 10. The hair curling appliance cradle 158 also includes a transformer 166 and voltage rectifier means (not shown) for supplying power to recharge the rechargeable battery 138.

In the embodiment illustrated in FIG. 1, the outer member outer surface 98 also includes grooming means 170 for grooming hair. In the illustrated embodiment, such grooming means 170 comprises a plurality of uniformly spaced teeth extending radially outwardly from the outer member outer surface 98.

Figure 9:
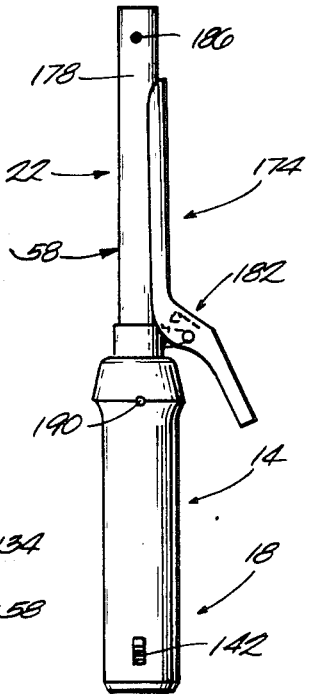
FIG. 9 is a perspective view of another embodiment of the hair curling appliance shown in FIG. 1.

In an alternate embodiment 174, as shown in FIG. 9, the outer member 58 has a generally smooth outer surface 178 and the hair curler 10 includes a hair clamping assembly 182. The clamp assembly 182 is suitably attached to the handle assembly 14 to permit the clamping of hair against the outer member 58.

As illustrated in FIGS. 1, 2, 7 and 9, the hair curler 10 can also include various means for indicating to the user the proper functioning of the hair curling appliance. More particularly, the outer member outer surface 98 includes a spot 186 of heat sensitive paint which changes colors when the heating element 22 reaches a proper heating temperature. The handle 18 also has mounted therein an LED light 190 for purposes of indicating when the switch 142 is on and energizing the resistance heating wire 62. The hair curler cradle 158 for charging the hair curler 10 also has mounted therein an LED light 194 for showing that proper contact has been made between the hair curler 10 and the charging contacts 164 in the cradle 158.

As illustrated in FIG. 8, a brush cover or housing 198 can also be used for facilitating storage and transportation of the hair curler 10.

Various of the features of the invention are set forth in the following claims.

We claim:

1. A hair curling appliance comprising a handle, a heating element fixedly extending from said handle, said heating element comprising an inner member including an inner surface and an outer surface, said inner member being generally elongated and tapered and made of heat insulating material and including an end fixed in said handle, a low resistance wire which has a periferial surface, which is disposed on said inner member, which comprises coated wire ranging between 14.20 mils and 25.35 mils in diameter, which is wound between 50 turns and 145 turns around said inner member, and which is between 5 feet and 18 feet in wound length, a generally elongated outer member fabricated of elastromeric material and including an end fixed in said handle, an outer surface, and an inner tapered surface telescopically receiving said inner member, and being deformed around said wire peripheral surface so as to increase the amount of surface contact and resultant heating by conduction between said low resistance wire and said outer member, means for energizing said low resistance wire comprising rechargeable power storage means secured in said handle, and means for connecting said power storage means to said low resistance wire and including manually operable switch means for energizing said low resistance wire.

2. A hair curling appliance in accordance with claim 1 wherein said outer member outer surface includes radially extending grooming means.

3. A hair curling appliance in accordance with claim 1 wherein said appliance further includes clamping means for clamping hair to said heating element.

4. A hair curling appliance in accordance with claim 1 wherein said outer member includes a portion made of heat conducting metal adjacent said wound low resistance wire.

5. A hair curling appliance comprising a handle, a heating element fixedly extending from said handle, said heating element comprising a generally elongated inner member made of heat insulating material and including an outer surface, a resistance wire which is disposed on said outer surface of said inner member, which has periferal surface, which comprises copper wiere ranging between 14.20 mils and 25.35 mils in diameter, which is wound between 50 turns and 145 turns around said inner member, and which is between 5 feet and 18 feet in wound length, a generally elongated outer member fabricated of elastomeric material and including an outer surface and an inner surface telescopically receiving said inner member and being deformed around said wire peripheral surface so as to increase the amount of surface contact and resultant heating by conduction between said resistance wire and said outer member, means for energizing said resistance wire comprising rechargeable power storage means secured in said handle, and means for connecting said power storage means to said resistance wire and including manually operable switch means for energizing said low resistance wire.

6. A hair curling appliance in accordance with claim 5 wherein said outer member outer surface includes radially extending grooming means.

7. A hair curling appliance in accordance with claim 5 wherein said appliance further includes clamping means for clamping hair to said heating element.

8. A hair curling appliance in accdordance with claim 5 wherein said outer member includes a portion made of heat conducting metal adjacent said wound resistance wire.

9. A hair curling appliance comprising a handle, a heating element comprising a generally elongated inner member made of heat insulating material, a resistance wire which is wound around said inner member and which includes a peripheral surface, a generally elongated outer member made of elastomeric material, telescopically recieving said inner member, and being deforming around said wire peripheral surface so as to increase the amount of surface contact and resultant heating by conduction between said resistance wire and siad outer member, means for energizing said resistance wire comprising rechargeable power storage means secured in said handle, and means for connecting said power storage means to said resistance wire and including manually operable switch means for energizing said resistance wire.

* * * * *